United States Patent [19]

Mayhew

[11] 4,020,694

[45] May 3, 1977

[54] APPARATUS FOR DISPLAYING AND MANIPULATING AN INDOOR/OUTDOOR THERMOMETER

[75] Inventor: Theron T. Mayhew, Emporia, Kans.

[73] Assignee: Hopkins Manufacturing Corporation, Emporia, Kans.

[22] Filed: Nov. 26, 1975

[21] Appl. No.: 635,690

[52] U.S. Cl. ..... 73/343 R; 73/339 C; 206/461

[51] Int. Cl.[2] ..... B65D 73/02

[58] Field of Search ..... 40/10 D, 125 R, 126 A; 206/306, 463, 461, 462, 469, 471; 73/339 C, 343 B, 343 R

[56] References Cited

UNITED STATES PATENTS

| | | | |
|---|---|---|---|
| 3,298,515 | 1/1967 | Watts | 206/471 |
| 3,645,384 | 2/1972 | Wind | 220/339 |
| 3,898,884 | 8/1975 | Hopkins | 73/339 C |

FOREIGN PATENTS OR APPLICATIONS

| | | | |
|---|---|---|---|
| 1,280,053 | 11/1961 | France | 206/463 |

*Primary Examiner*—S. Clement Swisher
*Assistant Examiner*—Denis E. Corr
*Attorney, Agent, or Firm*—Kenway & Jenney

[57] ABSTRACT

An apparatus for displaying and manipulating an indoor/outdoor thermometer characterized by a package structure which is alternatively operable to (1) display an indoor thermometer and an outdoor thermometer in displaced, mirror image relation in a common plane or (2) display the indoor thermometer and outdoor thermometer in a superimposed relation, simulating an actual installation on opposite window sides.

6 Claims, 8 Drawing Figures

FIG. 4
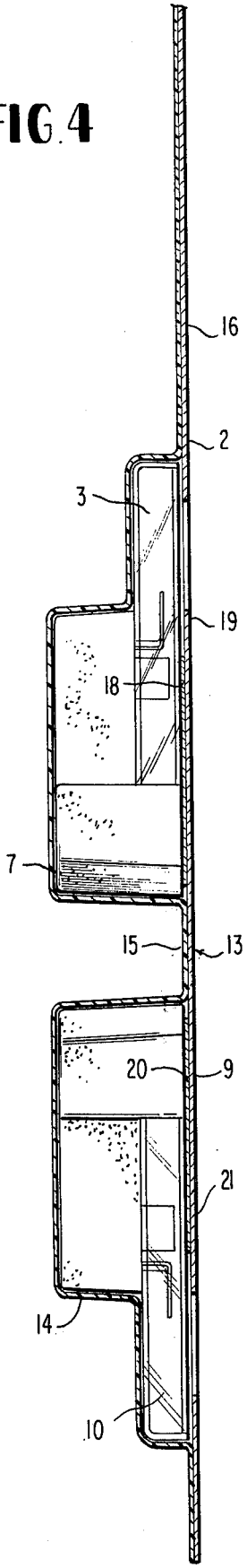
FIG. 5
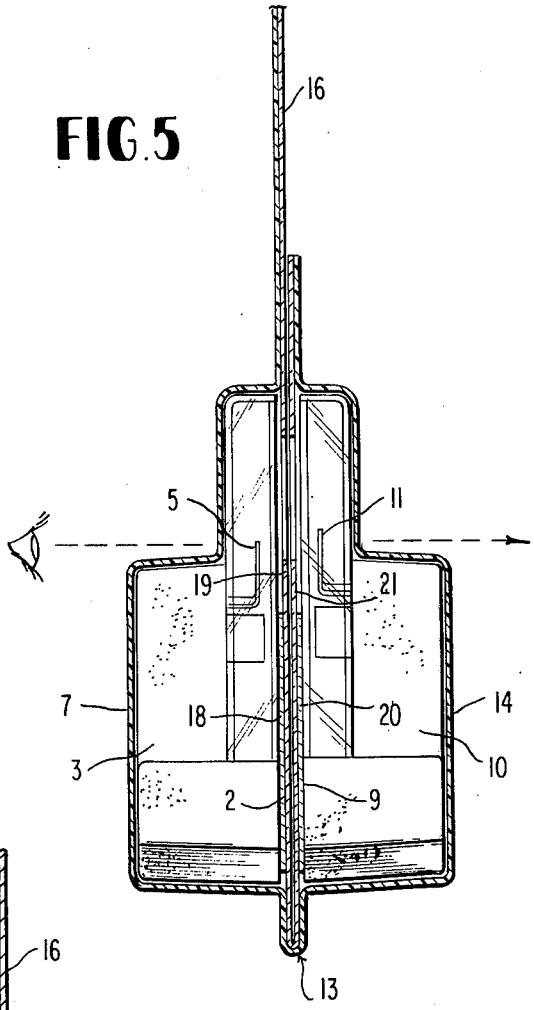
FIG. 7
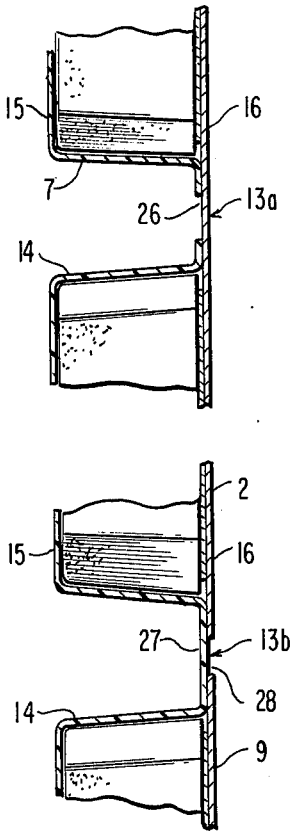
FIG. 8
FIG. 6
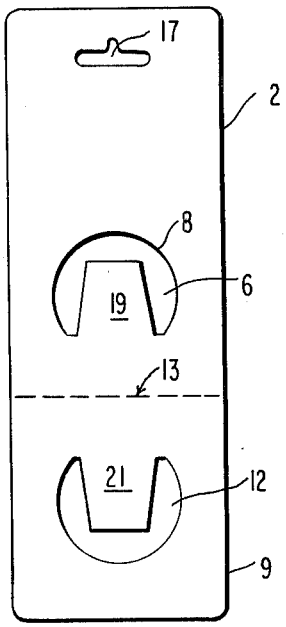

APPARATUS FOR DISPLAYING AND MANIPULATING AN INDOOR/OUTDOOR THERMOMETER

GENERAL BACKGROUND AND SUMMARY OF INVENTION

An indoor/outdoor thermometer believed to be characterized by a uniquely attractive appearance and particularly advantageous utility is featured in Hopkins, et al U.S. Pat. No. 3,898,884 Aug. 12, 1975).

This invention is directed to a packaging and display technique which is intended to stimulate purchaser interest and satisfy a prospective purchaser as to the appearance and utility of a completed installation of an indoor/outdoor thermometer of the type above noted.

The invention is characterized by a generally planer, but foldable, display sheet which is operable to support an indoor thermometer and outdoor thermometer in mutually inverted and displaced, mirror image relation when the display sheet is disposed in a "flat" or unfolded condition. When the display sheet is folded, the indoor thermometer and outdoor thermometer are brought into a superimposed relationship, simulating an actual installation as set forth for example in FIG. 3 of the above noted Hopkins, et al U.S. Pat. No. 3,898,884 (to the extent relevent to the present invention, the disclosure of the aforesaid Hopkins, et al U.S. Pat. No. 3,898,884 is herein incorporated by reference).

Other collateral, and independently significant facets of the display and packaging concept of the present invention reside in combinations of means for supporting the indoor and outdoor thermometer on a display panel, means for protecting and overlying adhesive mounting tab means contained on the indoor and outdoor thermometer units, and means for high-lighting a temperature scale contained on one of the thermometer units and illuminating legend means carried by at least one of the thermometer units.

In its basic aspects, the invention is characterized by an apparatus for displaying and manipulating two thermometers. The apparatus comprises first panel means operable to support and display one thermometer means. A first thermometer means, supported by the first panel means, includes a temperature scale and a first temperature indicator operable to cooperate with the temperature scale to indicate temperature readings. A first, window simulating, opening means is carried by the first panel means. A first securing means supports the first thermometer means on the first panel means, with the temperature scale being located in the first, window simulating opening means.

The apparatus further comprises second panel means operable to support and display another thermometer means. This other thermometer means comprises a second thermometer means including a second temperature indicator which is operable to cooperate with the temperature scale, above noted, to indicate temperature readings. A second, window simulating opening means is carried by the second panel means. Second securing means support the second thermometer means on the second panel means, with the second temperature indicator being located in the second, window simulating opening means.

Hinge means hingedly connect the first panel means and the second panel means, with the second thermometer means, supported on the second panel means, being mounted in inverted relation relative to the first thermometer means while the first panel means and second panel means are disposed in a generally unhinged relationship.

The second panel means is operable to fold about the hinge means and position the second temperature indicator in temperature reading cooperation with the temperature scale of the first thermometer means.

In the preferred embodiment of the invention, the first and second thermometers comprise indoor temperature and outdoor temperature indicating thermometer units.

Other aspects of the invention, considered to entail independent significance, include transparent film means for supporting the first and second thermometer units on the first and second panel means respectively, in mutually inverted and generally mirror image relation, with this transparent film means defining the first and second securing means.

Additional, independently significant facets of the invention reside in panel tab means arrangement for overlying and thereby protecting mounting adhesive means associated with each of the two thermometer units.

Still further aspects of the invention worthy of independent consideration entail unique arrangements for highlighting the aforesaid temperature scale and illuminating legend means carried by the first panel means.

In describing the invention with respect to details thereof, reference will be made to a presently preferred embodiment This embodiment is illustrated in the appended drawings by way of example, rather than by way of limitation.

DRAWINGS

In the drawings appended to this application there is depicted a presently preferred embodiment of an apparatus for displaying and manipulating an indoor thermometer and outdoor thermometer assembly of the type featured in the above noted Hopkins, et al U.S. Pat. No. 3,898,884.

In these drawings:

FIG. 1 provides a perspective, elevational view of the display and manipulating apparatus of the present invention, illustrated in an unfolded, upright condition, with an upright indoor thermometer being supported, in a mirror image sense, above an inverted outdoor thermometer;

FIG. 2 provides a perspective, elevational view schematicly illustrating the folding of the display panel means of the FIG. 1 arrangement so as to bring the lower mounted, outdoor thermometer into superimposed relation relative to and behind the indoor thermometer unit;

FIG. 3 provides a fragmentary, enlarged, front elevational view of the FIG. 2 arrangement, after folding has been completed so as to bring the outdoor thermometer into fully superimposed relationship with the rear of the indoor thermometer unit;

FIG. 4 provides an enlarged sectional view of the FIG. 1 apparatus as viewed along section line 4—4 of FIG. 1;

FIG. 5 provides a transverse sectional view of the FIG. 2 orientation of the display package, after complete folding has been effected, this view being taken along the area of section line 5—5 of FIG. 2;

FIG. 6 provides a reduced scale view of the rear of the display package, depicted in the unfolded condition of FIG. 1;

FIG. 7 provides a fragmentary sectional view, like that of FIG. 4, but directed to an alternative arrangement wherein a transparent film securing means does not overlie a hinge line;

FIG. 8 provides a still further alternative embodiment, illustrating a fragmentary portion of the hinge area, in the manner set forth in FIG. 4, and depicting an arrangement where the first and second panel means are separated at the hinge line, rather than being continuous as described in connection with the principal embodiment.

DETAILED DESCRIPTION

Figure 1:
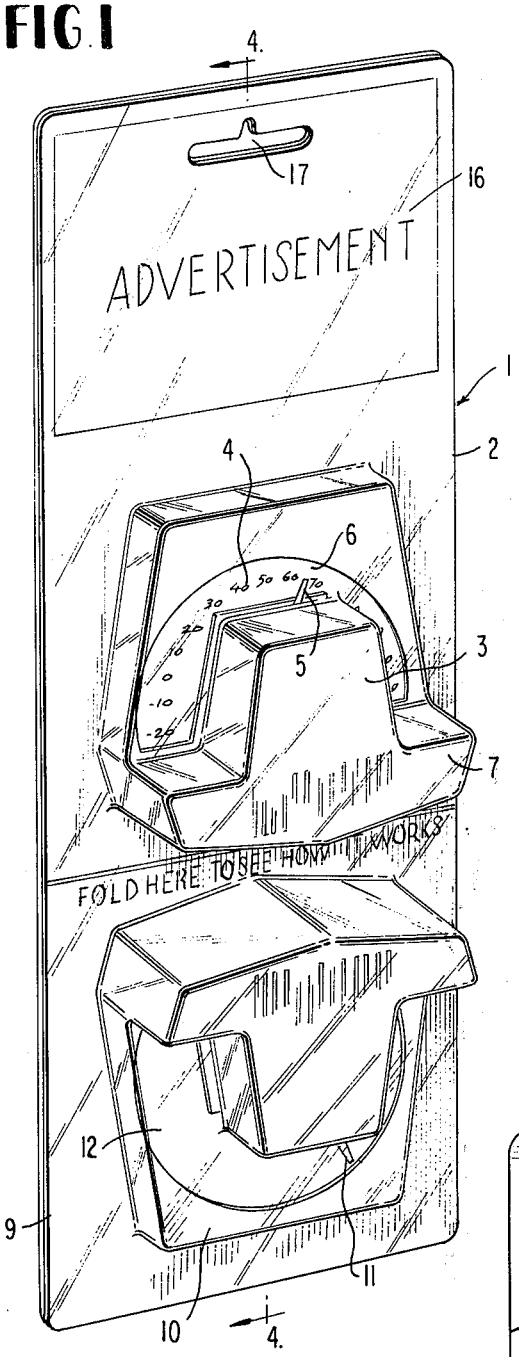

As earlier indicated, the present invention is directed to a unique concept for displaying and packaging an indoor/outdoor thermometer.

The invention finds particular utility when used in connection with indoor/outdoor thermometers of the type depicted in Hopkins, et al U.S. Pat. No. 3,898,884 (Aug. 12, 1975) issued to the Assignee of the present invention.

In describing the present invention, reference will first be made to basic structural details of an apparatus for displaying and manipulating an indoor/outdoor thermometer. Following this discussion of basic details, detailed discussions will be presented in relation to other collateral and independently significant facets of the invention, as above noted.

Basic Structure

FIG. 1 through 6 depict a presently preferred embodiment of a package and display apparatus 1 which is intended to display and permit customer manipulation of indoor thermometer and outdoor thermometer means.

Apparatus 1 includes first panel means 2 which may be fabricated from material such as cardboard. Panel 2 is operable to support and display an indoor thermometer 3. (Indoor thermometer 3 may comprise the indoor thermometer unit 10 of the above noted Hopkins, et al patent).

This indoor thermometer unit 3 may include a temperature scale 4 arranged in a generally arcuate pattern as shown in FIG. 1. Indoor thermometer 3 may further include a temperature indicator 5 which is operable to cooperate with the temperature scale 4 and thereby indicate an indoor temperature reading.

Figure 3:
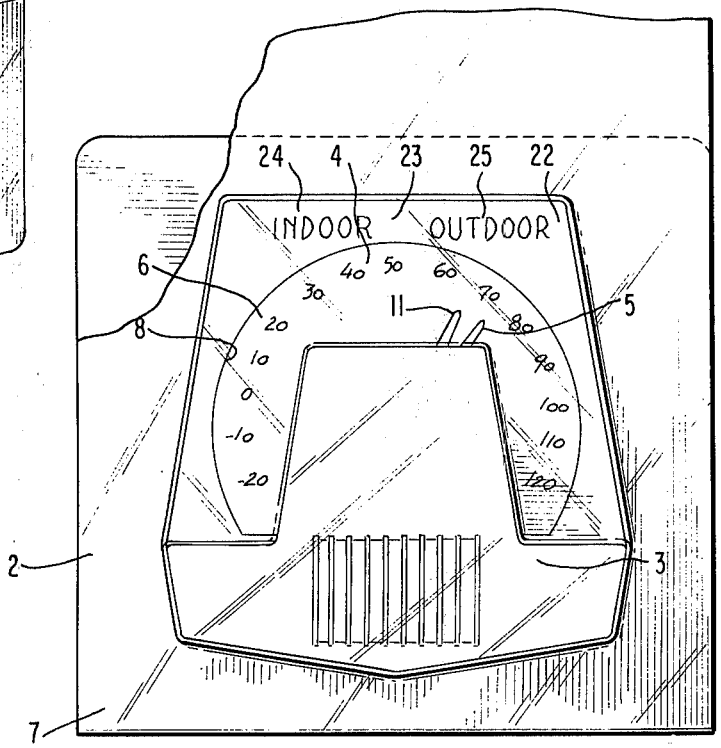

As will be apparent from FIGS. 3 and 6, the first panel 2 includes a first, window simulating opening 6. This window simulating opening 6 may comprise a circular segment as shown, encircling, in a generally contiguous and high-lighting relation, the arcuate temperature scale 4.

A first securing means 7 serves to support the indoor thermometer 3 on the first panel 2 so as to fixedly locate the thermometer 3 relative to the panel 2, with with the temperature scale 4 located in generally coaxial relation with the opening 6, and lying slightly laterally within the opening edge 8.

First securing means 7 comprises transparent film means, details of which will be subsequently considered at greater length.

A second panel 9, which may be also formed of cardboard and comprise a generally planer continuation of the web defining panel 2, is operable to support and display an outdoor thermometer 10. Outdoor thermometer 10 may comprise, for example, the outdoor thermometer 12 described and discussed in the above noted Hopkins, et al patent.

Outdoor thermometer unit 10 includes a second outdoor temperature indicator 11. Indicator 11 is operable to cooperate with the temperature scale 4 to indicate an outdoor temperature reading. The manner in which this operation is effected will be subsequently defined.

As will be apparent by reference to FIG. 6, second panel 9 includes a second, generally circular, segment, window simulating opening means 12. As shown in FIG. 6, first window simulating opening 6 and second window simulating opening 12 are disposed in a generally mirror image relation with respect to transverse, panel hinge joint 13 which serves to hingedly interconnect panels 2 and 9.

When panel 9 is folded about hinge means 13, as subsequently discussed, openings 6 and 12 are brought into superimposed and coextensive relation.

A second securing means 14, generally depicted in FIGS. 1 and 4, serves to support the outdoor thermometer 10 on the second panel 9, with the second temperature indication 11 being located within the second window simulating opening 12.

The second securing means 14 may comprise thermal plastic, transparent film means. Thus each of the securing means 3 and 4 may comprise portions of a thermal plastic, heat and vacuum formed, transparent film layer 15 which fully overlies a unitary cardboard web means 16 providing each of the panels 2 and 9. As shown, thermometer securing means 7 and 14 may be formed by heat and vacuum techniques, will understood in the art, to provide a conforming and supporting relationship with respect to the exterior surfaces of the thermometer units 3 and 10, so as to secure the thermometer units against the panel means 16. In this connection, it will be recognized that the thermometer units 3 and 10 are each configured such that their peripheral portions overlap the edges of the openings 6 and 12, so as to by firmly sandwiched between the plastic lamina 15 (providing securing means 7 and 14) and the foldable panel lamina 16. (It will here be understood that the plastic sheet 15 and cardboard 16 are adhesively bonded, and may be fully coextensive, in the areas of the apparatus 1 external of the securing means 7 and 14).

Hinge means 13, earlier noted may comprise a scored or otherwise weakened zone, of the superimposed and adhesively bound portions of plastic layer 15 and cardboard layer 16 extending transversely of the upright, longitudinal axis of package unit 1.

Hinge means 13 thus defines a "mirror image" fold line extending transversely of the longitudinal axis of the apparatus 1, between thermometer units 3 and 10. Hinge means 13 hingedly connects the first panel means 2 and the second panel means 9.

The outdoor thermometer 10 is mounted in inverted, mirror image relation relative to the indoor thermometer 3 with respect to the hinge line 13 while the panels 2 and 9 are disposed in the generally unfolded relationship shown in FIG. 1.

Figure 2:
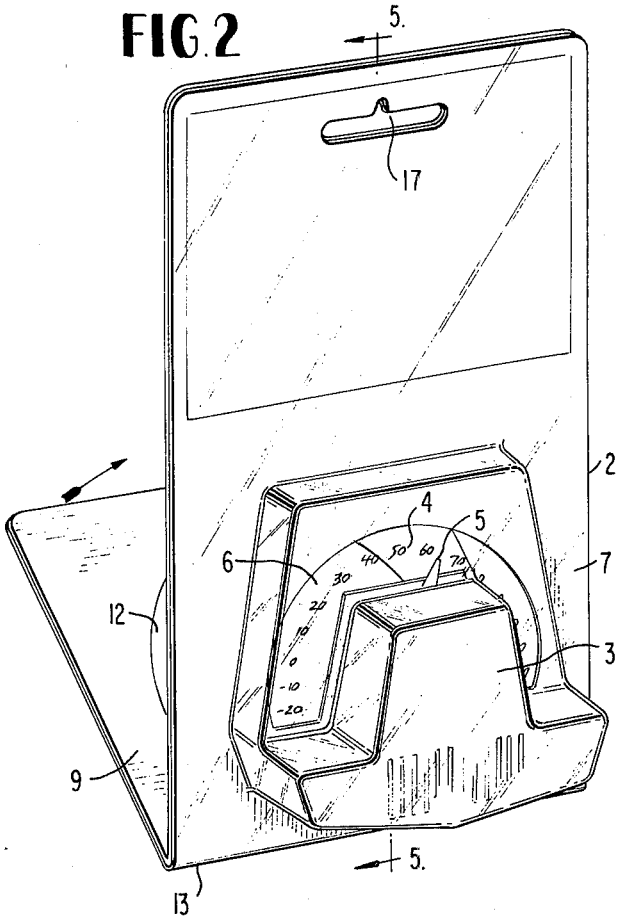

However, as shown in FIG. 2, the second panel 9 is operable to fold about the hinge 13, thereby position the outdoor temperature indicator 11 in temperature reading cooperation with the temperature scale 4 of the indoor thermometer 3, as generally depicted in FIG. 3.

FIG. 3 depicts the apparatus 1, where the panel 9 has been folded into parallel or superimposed relation with the back of the panel 2. In this condition, with the window simulating openings 6 and 12 being superimposed, the display apparatus 1 simulates an indoor/outdoor mounting arrangement for the thermometer units 3 and 10 as generally described in the above noted Hopkins, et al patent.

Of course, it will here be understood that the superimposed window opening means 6 and 12 cooperates to present the appearance of a window which serves to support the thermometer units 3 and 10 on opposite sides, i.e., a simulated inside and outside location.

By being able to manipulate the apparatus 1 so as to simulate an actual intended installation, a prospective purchaser is able to satisfy his curiosity as to how a completed installation will appear.

Support Means

As noted, apparatus 1 includes transparent film means 14 fully overlying first panel means 2, the indoor thermometer means 3, the second panel means 9, the outdoor thermometer means 14, and the hinge means 13.

Apparatus 1 may further include display or advertising means 16 carried by the first panel means 2. The display 16 may be operable to visually indicate an intended relative association of the indoor thermometer means 3 and the outdoor thermometer means 10. Moreover, the transparent film means 15 may overlie this display means 16.

As noted, the transparent film means 15 provides and defines each of the first and second securing means 7 and 14. In addition, the apparatus includes support or panel aperture means 17. This supporting means 17 is operable to support the first panel means 2 with the display means 16 disposed thereabove and the second panel means 9 disposed therebelow.

Adhesive Mounting Unit Protection

As noted in the above identified Hopkins, et al patent, the indoor thermometer means 3 may include a first adhesive tab means 18. This tab means 18 is operable to affix the indoor thermometer means to the inside of a window when the indoor thermometer means is removed from the first securing means 7 and the first panel means 2 (by rupturing film 15).

In this connection, the first panel means 2 further includes first tab means 19 projecting into the first, window simulating, opening means 6 and overlying and shielding the first adhesive tab means 19.

Similarly, the outdoor thermometer means 10 includes a second adhesive tab means 20. This tab means 20 is operable to affix the outdoor thermometer means 10 to the outside of a window when the outdoor thermometer means 10 is removed from the second securing means 14 and second panel means 9 (by rupturing film 15).

As in the case of the first panel, the second panel means 9 further includes a second tab means 21 projecting into the second, window simulating, opening means 12 and overlying and shielding the second adhesive tab means 20.

Scale Highlighting and Legend Illuminating

As will be apparent with reference to FIGS. 1 and 3, the edge 8 of the first, window simulating, opening means 6 defines temperature scale highlighting means operable to visually accentuate the location of the temperature scale 4.

Moreover, the first panel means 2 includes legend illuminating means 22 which may comprise a white panel area. In association with illuminating means 22, the indoor thermometer means 3 includes legend means 23 overlying the legend illuminating means 22. The legend means 22 diversely indicates relative indoor and outdoor temperature indicating functions of the first, indoor temperature indicator 5 and the second, outdoor temperature indicator 11 of the indoor thermometer means 3 and outdoor thermometer means 10 respectively. This diverse indication may be accomplished by a legend area 24 being color coded in the same color as indicator 5 and a legend area 25 color coded in the same color as indicator 11, with the colors of indicators 5 and 11 being different.

Alternative Arrangements

By way of example, FIGS. 7 and 8 depict modified forms of laminated arrangements of the thermal plastic mounting means 15 and panel defining, web means 16 which may be employed in the practice of the invention.

As shown in FIG. 7, a modified hinge joint 13*a* may be provided where the panel means 16 is continuous in the hinge joint area, but a separation 26 exists between the sections 7 and 14 of the thermometer supporting, thermal plastic lamina means 15.

FIG. 8 depicts another modification where a modified hinge joint 13*b* is provided. This modified hinge joint 13*b* results from the maintenance of a continuous plastic film area 27 between the thermometer supporting areas 7 and 14, with a discontinuity 28 being provided between the panel sections 2 and 9.

Variations of this nature will be immediately apparent to those skilled in the art and familiar with the disclosure of the present invention.

Other variations may comprise modifications in the extent to which the plastic film means 15 overlies the panel means 16, as well as variations in the structural and material characteristics of the panel means and thermometer mounting means.

SUMMARY OF MAJOR ADVANTAGES AND OVERALL SCOPE OF INVENTION

A principal advantage of the invention resides in the manner in which the foldable display panel arouses prospective purchaser interest and permits a prospective purchaser to simulate an actual installation of an indoor/outdoor thermometer unit.

Moreover, in addition to stimulating customer interest and permitting simulation of an actual installation, the apparatus of the present invention provides a packaging technique which affords significant protection for the indoor/outdoor thermometer units during transportation and display while economizing on the cost of the packaging operation.

The thermal plastic film thermometer supporting arrangement facilitates the mirror image positioning of the indoor and outdoor thermometer units so as to permit the display of these units in the inverted relation shown in FIG. 1, or the manipulation of the package into the installation simulating, superimposed relationship depicted in FIG. 3.

The panel tab arrangements, above described, provide significant protection for adhesive mounting tabs of the indoor/outdoor thermometer units and are believed to reinforce the thermometer mounting panels in the window simulating opening areas.

In addition, the utilization of the window simulating opening means to (1) highlight and visually accentuate the temperature scale area, and (2) illuminate the legends indicating the diverse indoor/outdoor temperature indicating functions, serves as an eye catching arrangement intended to accentuate prospective customer interest.

Those familiar with the present disclosure and skilled in the art to which the invention pertains will recognize additions, deletions, substitutions, and other modifications which would fall within the purview of the invention as set forth in the appended claims.

What is claimed is:

1. An apparatus for displaying and manipulating two thermometers, said apparatus comprising:

first panel means operable to support and display one thermometer;

a first thermometer means including
a temperature scale, and
a first temperature indicator operable to cooperate with said temperature scale to indicate temperature readings;

first, window simulating, opening means carried by said first panel means;

first securing means supporting said first thermometer means on said first panel means, with said temperature scale being located in said first, window simulating opening means;

second panel means operable to support and display another thermometer;

second thermometer means including
a second temperature indicator operable to cooperate with said temperature scale to indicate temperature readings;

second, window simulating, opening means carried by said second panel means;

second securing means supporting said second thermometer means on said second panel means, with said second temperature indicator being located in said second, window simulating opening means; and hinge means hingedly connecting said first panel means and said second panel means, with said second thermometer means supported on said second panel means being mounted in inverted relation relative to said first thermometer means while said first panel means and second panel means are disposed in a generally unfolded relationship;

said second panel means being operable to fold about said hinge means and position said second temperature indicator in temperature reading cooperation with said temperature scale of said first thermometer means;

said first securing means being independent of said second panel means;

said second securing means being independent of said first panel means;

said first securing means and said second securing means being relatively moveable and operable to permit said folding of said second panel means about said hinge means; and said first panel means, with said first thermometer means secured thereto by said first securing means, and said second panel means, with said second thermometer means secured thereto, being relatively moveable between said unfolded relationship, wherein said first thermometer means and said second thermometer means are disposed in a spaced, mutually inverted relation and displayed on one side of generally planor panel means defined by said first and second panel means, and a folded relationship, wherein said first panel means and second panel means are mutually overlapping and said first thermometer means and second thermometer means are displayed on opposite sides of said overlapping first and second panel means.

2. An apparatus for displaying and manipulating an indoor/outdoor thermometer, said apparatus comprising:

first panel means operable to support and display an indoor thermometer;

an indoor thermometer means including
a temperature scale, and
a first, indoor temperature indicator operable to cooperate with said temperature scale to indicate temperature readings;

first, window simulating, opening means carried by said first panel means;

first securing means supporting said indoor thermometer means on said first panel means, with said temperature scale being located in said first, window simulating opening means;

second panel means operable to support and display an outdoor thermometer;

an outdoor thermometer means including
a second, outdoor temperature indicator operable to cooperate with said temperature scale to indicate temperature readings;

second, window simulating opening means carried by said second panel means;

second securing means supporting said outdoor thermometer means on said second panel means, with said second temperature indicator being located in said second, window simulating opening means; and hinge means hingedly connecting said first panel means and said second panel means, with said outdoor thermometer means supported on said second panel means being mounted in inverted relation relative to said indoor thermometer means while said first panel means and second panel means are disposed in a generally unfolded relationship;

said second panel means being operable to fold about said hinge means and position said outdoor temperature indicator in temperature reading cooperation with said temperature scale of said indoor thermometer means;

said first securing means being independent of second panel means;

said second securing means being independent of said first panel means;

said first securing means and said second securing means being relatively moveable and operable to permit said folding of said second panel means about said hinge means; and said first panel means, with said indoor thermometer means secured thereto by said first securing means, and said second panel means, with said outdoor thermometer means secured thereto by said second securing means, being relatively moveable between said unfolded relationship, wherein said indoor thermometer means and said outdoor thermometer means are disposed in a spaced, mutually inverted relation and displayed on one side of generally planor means defined by said first and second panel means, and a folded relationship, wherein said first panel means and second panel means are mutually overlapping and said indoor thermometer means and outdoor thermometer means are displayed on opposite sides of said overlapping first and second panel means.

3. An apparatus as described in claim 2 wherein:

said apparatus includes transparent film means overlying said first panel means, said indoor thermometer means, said second panel means, said outdoor thermometer means, and said hinge means;

said apparatus further includes display means carried by said first panel means and operable to indicate an intended relative association of said indoor thermometer means and said outdoor thermometer means;

said transparent film means overlies said display means;

said transparent film means provides and defines each of said first and second securing means; and said apparatus further includes supporting means operable to support said first panel means with said display means disposed thereabove and said second panel means being disposed therebelow.

4. An apparatus as described in claim 2 wherein:

said first, window simulating, opening means defines temperature scale highlighting means operable to visually accentuate the location of said temperature scale;

said first panel means includes legend illuminating means; and said indoor thermometer means includes legend means overlying said legend illuminating means and diversely indicating relative indoor and outdoor temperature indicating functions of said first, indoor temperature indicator and second, outdoor temperature indicator of said indoor thermometer means and outdoor thermometer means, respectively.

5. An apparatus for displaying and manipulating an indoor/outdoor thermometer, said apparatus comprising:

first panel means operable to support and display an indoor thermometer;

an indoor thermometer means including a temperature scale, and a first, indoor temperature indicator operable to cooperate with said temperature scale to indicate temperature readings;

first, window simulating, opening means carried by said first panel means;

first securing means supporting said indoor thermometer means on said first panel means, with said temperature scale being located in said first, window simulating opening means;

second panel means operable to support and display an outdoor thermometer;

an outdoor thermometer means including a second, outdoor temperature indicator operable to cooperate with said temperature scale to indicate temperature readings;

second, window simulating opening means carried by said second panel means;

second securing means supporting said outdoor thermometer means on said second panel means, with said second temperature indicator being located in said second, window simulating opening means;

hinge means hingedly connecting said first panel means and said second panel means, with said outdoor thermometer means supported on said second panel means being mounted in inverted relation relative to said indoor thermometer means while said first panel means and second panel means are disposed in a generally unfolded relationship;

said second panel means being operable to fold about said hinge means and position said outdoor temperature indicator in temperature reading cooperation with said temperature scale of said indoor thermometer means;

said indoor thermometer means including first adhesive means operable to affix said indoor thermometer means to a window when said indoor thermometer means is removed from said first securing means and first panel means;

said first panel means further including first tab means projecting into said first, window simulating, opening means and overlying and shielding said first adhesive means;

said outdoor thermometer means including second adhesive means operable to affix said outdoor thermometer means to said window when said outdoor thermometer means is removed from said second securing means and second panel means; and said second panel means further including second tab means projecting into said second, window simulating, opening means and overlying and shielding said second adhesive means.

6. An apparatus for displaying and manipulating an indoor/outdoor thermometer, said apparatus comprising:

first panel means operable to support and display an indoor thermometer;

an indoor thermometer means including a temperature scale, and a first, indoor temperature indicator operable to cooperate with said temperature scale to indicate temperature readings;

first, window simulating, opening means carried by said first panel means;

first securing means supporting said indoor thermometer means on said first panel means, with said temperature scale being located in said first, window simulating opening means;

second panel means operable to support and display an outdoor thermometer;

an outdoor thermometer means including a second, outdoor temperature indicator operable to cooperate with said temperature scale to indicate temperature readings;

second, window simulating opening means carried by said second panel means;

second securing means supporting said outdoor thermometer means on said second panel means, with said second temperature indicator being located in said second, window simulating opening means;

hinge means hingedly connecting said first panel means and second panel means, with said outdoor thermometer means supported on said second panel means being mounted in inverted relation relative to said indoor thermometer means while said first panel means and second panel means are disposed in a generally unfolded relationship;

said second panel means being operable to fold about said hinge means and position said outdoor temperature indicator in temperature reading cooperation with said temperature scale of said indoor thermometer means;

said apparatus including transparent film means overlying, at least in part, said first panel means, said indoor thermometer means, said second panel means, and said outdoor thermometer means;

said apparatus further including display means carried by said first panel means and operable to indicate an intended relative association of said indoor thermometer means and said outdoor thermometer means;

said transparent film means providing and defining each of said first and second securing means;

said apparatus further including supporting means operable to support said first panel means with said display means disposed thereabove and said second panel means being disposed therebelow;

said indoor thermometer means including first adhesive means operable to affix said indoor thermometer means to a window when said indoor thermometer means is removed from said first securing means and first panel means;

said first panel means further including first tab means projecting into said first, window simulating, opening means and overlying and shielding said first adhesive means;

said outdoor thermometer means including second adhesive means operable to affix said outdoor thermometer means to said window when said outdoor thermometer means is removed from said second securing means and second panel means;

said second panel means further including second tab means projecting into said second, window simulating, opening means and overlying and shielding said second adhesive means;

said first, window simulating, opening means defining temperature scale highlighting means operable to visually accentuate the location of said temperature scale;

said first panel means including legend illuminating means; and said indoor thermometer means including legend means overlying said legend illuminating means and diversely indicating relative indoor and outdoor temperature indicating functions of said first, indoor temperature indicator and second, outdoor temperature indicator of said indoor thermometer means and outdoor thermometer means, respectively.

* * * * *